United States Patent [19]

Gruber

[11] Patent Number: 4,551,663

[45] Date of Patent: Nov. 5, 1985

[54] LEVEL CONTROL DEVICE

[75] Inventor: George E. Gruber, Port Sanilac, Mich.

[73] Assignee: Ludlow Industries, Inc., Elburn, Ill.

[21] Appl. No.: 636,545

[22] Filed: Aug. 1, 1984

[51] Int. Cl.[4] ..... H01H 35/00

[52] U.S. Cl. ..... 318/482; 200/61.21; 340/617

[58] Field of Search ..... 318/482; 200/61.2, 61.21; 366/142; 310/68 B, 68 E; 340/615, 617

[56] References Cited

U.S. PATENT DOCUMENTS

| | | | |
|---|---|---|---|
| 2,851,553 | 9/1958 | Grostick | 340/617 X |
| 3,818,159 | 6/1974 | Evans et al. | 340/615 X |
| 4,095,064 | 6/1978 | Fleckenstein | 200/61.21 |
| 4,147,906 | 4/1979 | Levine | 200/61.21 X |
| 4,211,966 | 7/1980 | Sweet | 318/482 |
| 4,318,624 | 3/1982 | Jett | 366/349 |
| 4,377,731 | 3/1983 | Georgelin | 310/68 E X |

OTHER PUBLICATIONS

Catalog entitled Monitor Automatic Level Indicators, copyright 1979, published by Monitor Manufacturing, Elburn, Illinois 60119, a division of Ludlow Industries, Inc.

*Primary Examiner*—William M. Shoop, Jr.
*Assistant Examiner*—Bentsu Ro
*Attorney, Agent, or Firm*—Burmeister, York, Palmatier, Hamby & Jones

[57] ABSTRACT

A level control device is disclosed comprising a paddle on a rotary shaft projecting from a housing, a carrier disc coupled to the shaft and supporting a plurality of torque-transmitting levers having first arms engageable by drive pins or an apertured drive disc on an output shaft of an electric motor, an axially movable control plate biased toward the carrier by spring means which also cause the control plate to rotate with the carrier, the levers having second arms disposed between the carrier and the control plate for moving the control plate away from the carrier when the driving torque transmitted by the first arms increases due to increasing drag on the paddle caused by rising granular material coming into contact with the paddle, and a control switch operable by the movement of the control plate away from the carrier. The position of the switch is adjustable to provide a sensitivity adjustment. A slip clutch may be provided between the carrier and the paddle shaft.

20 Claims, 14 Drawing Figures

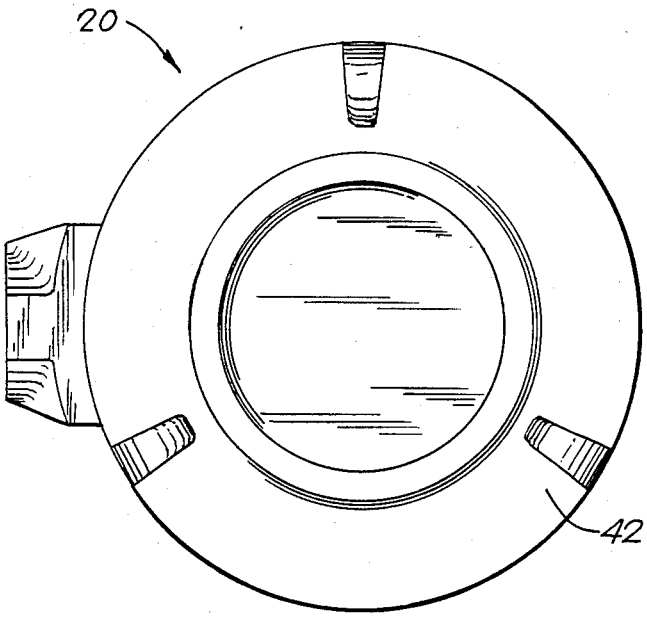
FIG. 3
FIG. 13
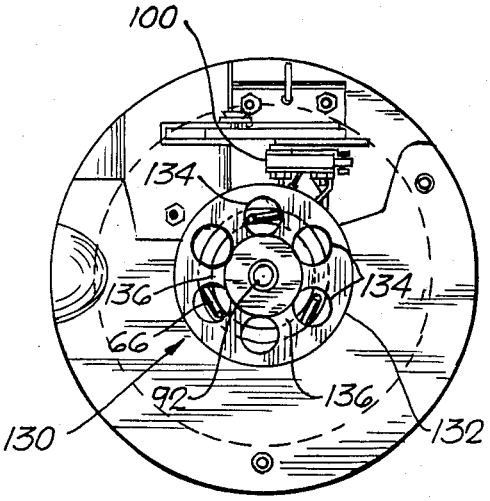
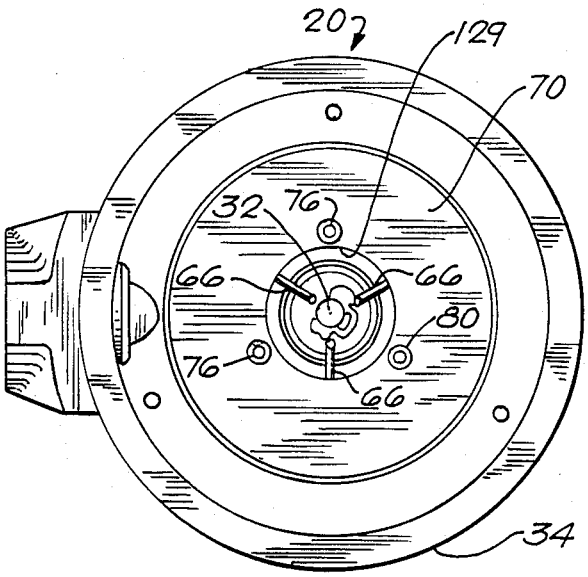
FIG. 5
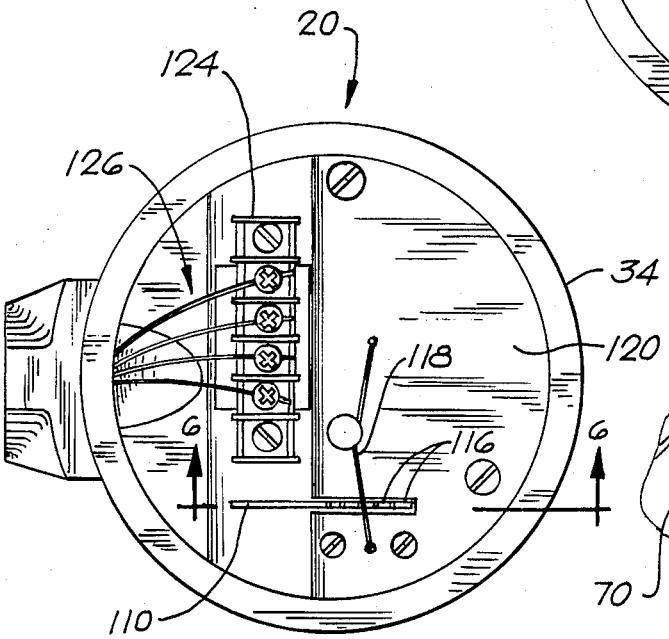
FIG. 4
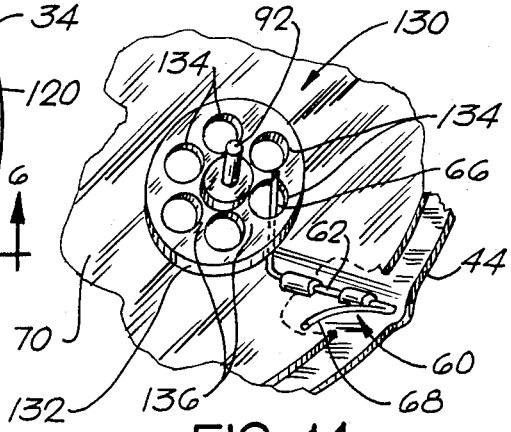
FIG. 14

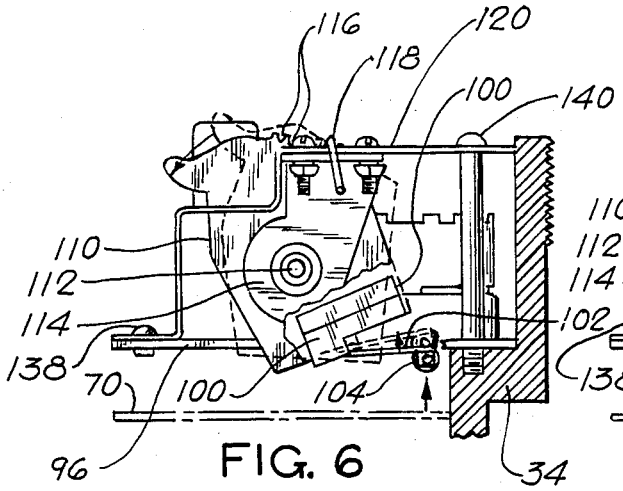
FIG. 6
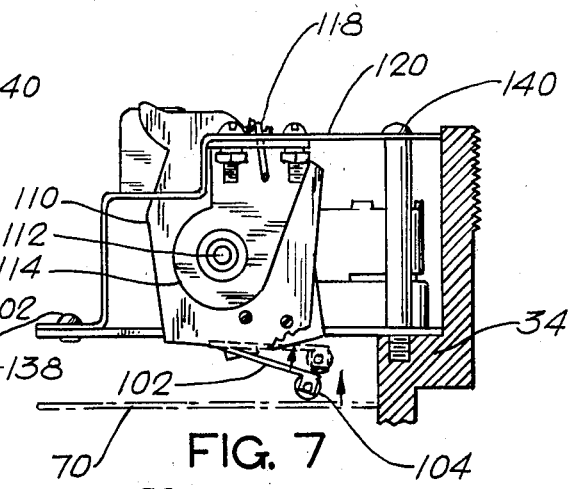
FIG. 7
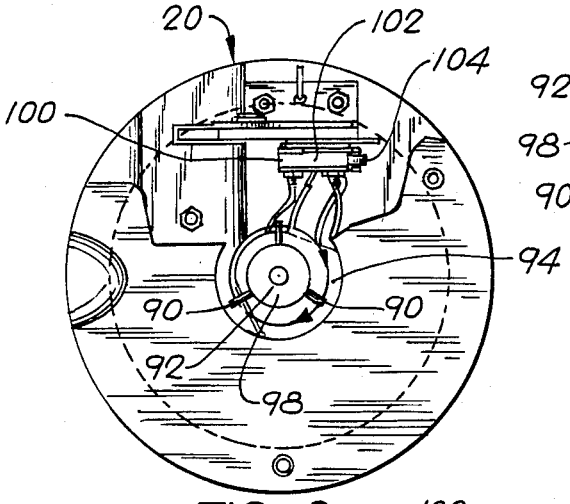
FIG. 8
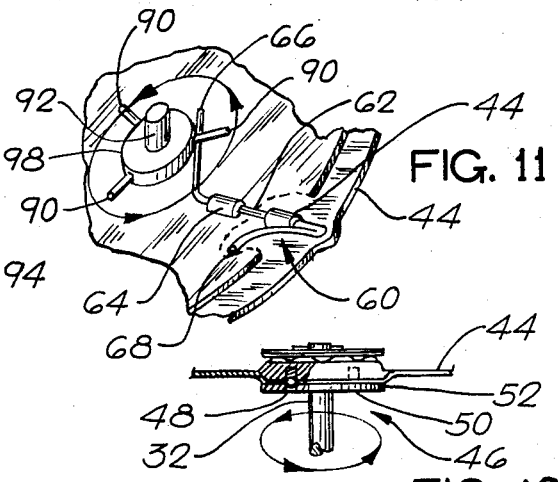
FIG. 11
FIG. 12
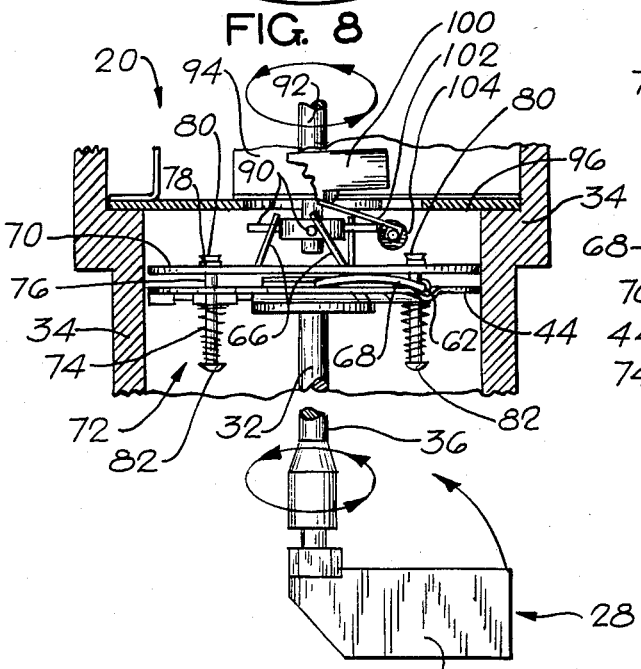
FIG. 9
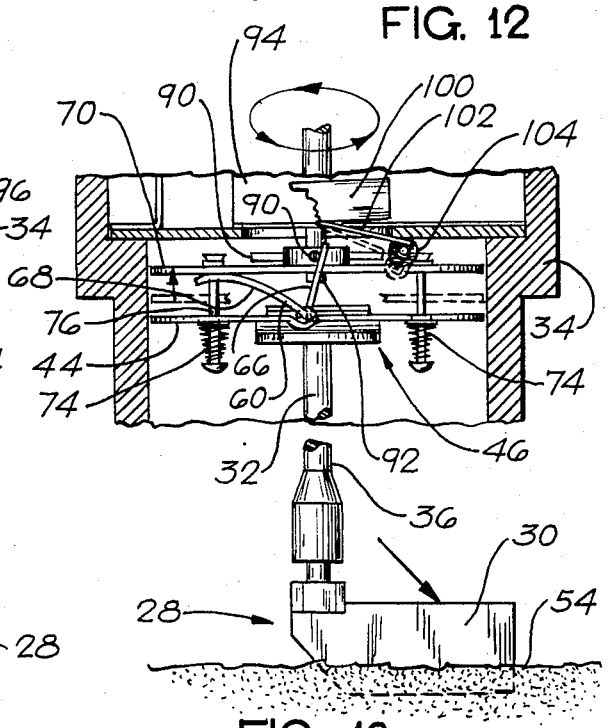
FIG. 10

LEVEL CONTROL DEVICE

FIELD OF THE INVENTION

This invention relates to a level control device for indicating and controlling the level of flowable materials, especially materials of a granular or particulate character, in bins, silos, tanks or other containers.

BACKGROUND OF THE INVENTION

It is known in the prior art to provide bin level indicators or control devices for use in bins or the like to indicate, as by operating an electrical control switch, when granular material or the like rises in the bin to the level being monitored by the bin level indicator. The switch can be employed to actuate an alarm, to stop the flow of the granular material into the bin, or to cause the discharge of the granular material from the bin.

One common type of bin level indicator or control device is the rotary paddle type, in which the control device comprises a rotary paddle wheel or drag member which is normally rotated freely by an electric motor. When the granular material rises sufficiently in the bin to come into contact with the rotary paddle wheel, the granular material impedes or stops the rotation of the paddle wheel, whereupon the control switch in the bin level indicator is operated. Many bin level control devices of this type are of the general construction represented by the Fleckenstein U.S. Pat. No. 4,095,064 and the Sweet U.S. Pat. No. 4,211,966. In this general construction, the entire electric drive motor is mounted on a swingable or swivel support and is adapted to swing or swivel against the biasing action of a spring, when the torque reaction on the motor increases due to the increasing drag or stoppage of the rotary paddle wheel, when the granular material comes into contact with the paddle wheel. The swinging or swiveling movement of the electric motor operates the electrical control switch. This construction has the disadvantage that the electric drive motor has a significant mass and weight, which may tend to result in false signals, when the level control device is subjected to high levels of vibration.

SUMMARY OF THE INVENTION

One object of the present invention is to provide a new and improved level control device of the rotary paddle type, which does not rely upon the swivel movement of the electrical drive motor to operate the control switch, but rather operates the control switch in response to increasing torque which is being transmitted between the motor and the rotary paddle wheel.

A further object is to provide such a new and improved level control device which is economical and uncomplicated in contruction, yet is highly sensitive and reliable in operation.

To achieve these and other objects, the present invention may provide a level control device, comprising a housing, shaft means rotatable in the housing and having a projecting portion extending from the housing, paddle means on the projecting portion for engagement by rising material whose level is to be controlled, the rotation of the paddle means being impeded by the drag caused by the rising material, a carrier in the housing and mounted on the shaft means for rotation therewith, a plurality of levers swingably mounted on the carrier, an electrical drive motor in the housing and having a motor output shaft disposed generally in axial alignment with the shaft means, a plurality of drive elements mounted on the motor output shaft and rotatable therewith, the levers having respective first arms engageable with the drive elements for transmitting driving torque to the levers and then to the carrier, a control plate adjacent the carrier and movable toward and away from the carrier, spring means biasing the control plate toward the carrier and causing the control plate to rotate with the carrier, the levers having respective second arms disposed between the carrier and the control plate for moving the control plate away from the carrier when the driving torque transmitted by the first arms increases due to increasing drag on the paddle means caused by the biasing material, and control switch means engageable by the control plate and operable in response to movement of the control plate away from the carrier.

Each of the levers may have a pivot shaft portion pivotally mounted on the carrier. The first arm of each lever may extend laterally in one direction from the pivot shaft portion for engagement with one of the drive elements. The second arm of each lever may extend laterally in a different direction from the pivot shaft portion and may be disposed between the carrier and the control plate.

Each of the levers may be made of wire or rod material. The pivot shaft portion may extend generally in a radial direction relative to the shaft means. The first arm of each lever may be bent in one direction from one end of the pivot shaft portion for engagement with one of the drive elements. The second arm may be bent in a different direction from the opposite end of the pivot shaft portion and may be disposed between the carrier and the control plate. Such control plate may have a central opening through which the first arms of the levers extend for engagement with the drive elements.

More specifically, the first arm of each lever may be bent from the radially inward end of the pivot shaft portion, while the second arm may be bent from the radially outward end. The carrier may have bearing means for rotatably supporting the pivot shaft portions of the levers.

The drive elements may extend outwardly from the motor output shaft with spaces or openings between the drive elements for receiving the first arms of the levers. The switch means may comprise a movable operating member, preferably having a roller thereon for engaging the control plate.

The drive elements may comprise pins projecting generally in a radial direction from the motor output shaft for engagement with the first arms of the levers. In another preferred construction, the drive elements may be formed by a disc mounted on the motor shaft and having openings therein for receiving the levers.

The spring means may comprise a plurality of guide pins which extend slidably through openings in the carrier and the control plate. The guide pins may have heads on their opposite ends. Compression coil springs may be mounted on the pins and may be compressed between one of the plates, preferably the carrier plate, and the corresponding heads of the pins.

An overload slip clutch may be provided between the carrier and the shaft means to form a driving connection therebetween while providing for slippage under high torque conditions to prevent any possible damage to the level control device.

The switch means may be supported by adjustably movable mounting means to change the position of the switch means so as to adjust the degree of movement of the control plate required to operate the switch means. The movable mounting of the switch means provides a sensitivity adjustment.

In a broader sense, the present invention may provide a level control device comprising a housing, shaft means rotatable in the housing and having a projecting portion extending from the housing, a material contacting drag member on the projecting portion for contacting rising material whose level is to be controlled, the rotation of the drag member being impeded by the drag on such member caused by the rising material, a carrier in the housing and mounted on the shaft means for rotation therewith, at least one torque-transmitting device movably mounted on the carrier, a drive motor in the housing and having a motor output shaft with at least one drive element thereon, the torque-transmitting device having first means engageable with such drive element for transmitting driving torque to the first means and then to the carrier, a control member rotatable with the carrier and movable relative thereto in first and second directions, spring means biasing the control member in such first direction, the torque-transmitting device having second means for moving the control member in the second direction when the driving torque transmitted by the first means increases due to increasing drag on the drag member caused by the rising material, and control switch means engageable by the control member and operable in response to movement of the control member in the second direction by the torque-transmitting device.

The torque-transmitting device may comprise a lever swingably mounted on the carrier, such first and second means comprising first and second arms of the lever for engagement with the drive element and the control member.

The torque-transmitting device may be one of a plurality of such devices movably mounted on the carrier and spaced at angular intervals around the shaft means. The control member may be movable generally in first and second axial directions toward and away from the carrier relative to the axis of the shaft means. The drive element may comprise one of a plurality of such drive elements for engagement with the first means of the torque-transmitting devices.

Each of the torque-transmitting devices may comprise a lever swingably mounted on the carrier. The first and second means of each torque-transmitting device may comprise first and second arms of the corresponding lever for engagement with the corresponding drive element and with the control member for moving such member against the biasing action of the spring means.

Such spring means may comprise springs mounted on guide means extending between the carrier and the control member for biasing the control member toward the carrier. The second arms of the levers may extend between the carrier and the control member for moving the control member away from the carrier in response to the transmission of increasing torque between the drive elements and the first arms of the levers. The switch means may comprise a movable operating member engageable with the control member for operating the switch means in response to movement of the control member away from the carrier. The position of the switch means may be adjustable to provide a sensitivity adjustment.

BRIEF DESCRIPTION OF THE DRAWINGS

Further objects, advantages and features of the present invention will appear from the following description, taken with the accompanying drawings, in which:

FIG. 3 is a plan view of the level control device.

FIG. 4 is a plan view with the cover of the device removed.

FIG. 5 is a plan view with additional parts removed, including the terminal board, the drive motor, the control switch and the supporting members for such components.

FIG. 6 is a fragmentary elevational section, taken generally along the line 6—6 in FIG. 4, and showing the sensitivity adjusting mechanism for moving the position of the control switch.

FIG. 7 is a view similar to FIG. 6, but showing the adjusting mechanism in a changed position.

FIG. 8 is a bottom plan view of the components removed from the level control device as shown in FIG. 5, including the drive motor and the control switch.

FIG. 9 is a fragmentary central longitudinal section showing the level control device in the condition which prevails when the paddle or drag member is freely rotating.

FIG. 10 is a view similar to FIG. 9, but showing the components in the changed positions which they assume when the paddle or drag member is impeded or stopped by rising granular material in the bin or other container.

FIG. 11 is a fragmentary diagrammatic perspective view showing the drive elements and one of the torque-transmitting levers.

FIG. 12 is a fragmentary elevation, partly in central longitudinal section, showing the overload slip clutch between the carrier and the paddle shaft.

FIGS. 13 and 14 are views similar to FIGS. 5 and 11, but showing a modified construction.

DETAILED DESCRIPTION OF AN ILLUSTRATIVE EMBODIMENT

Figure 1:
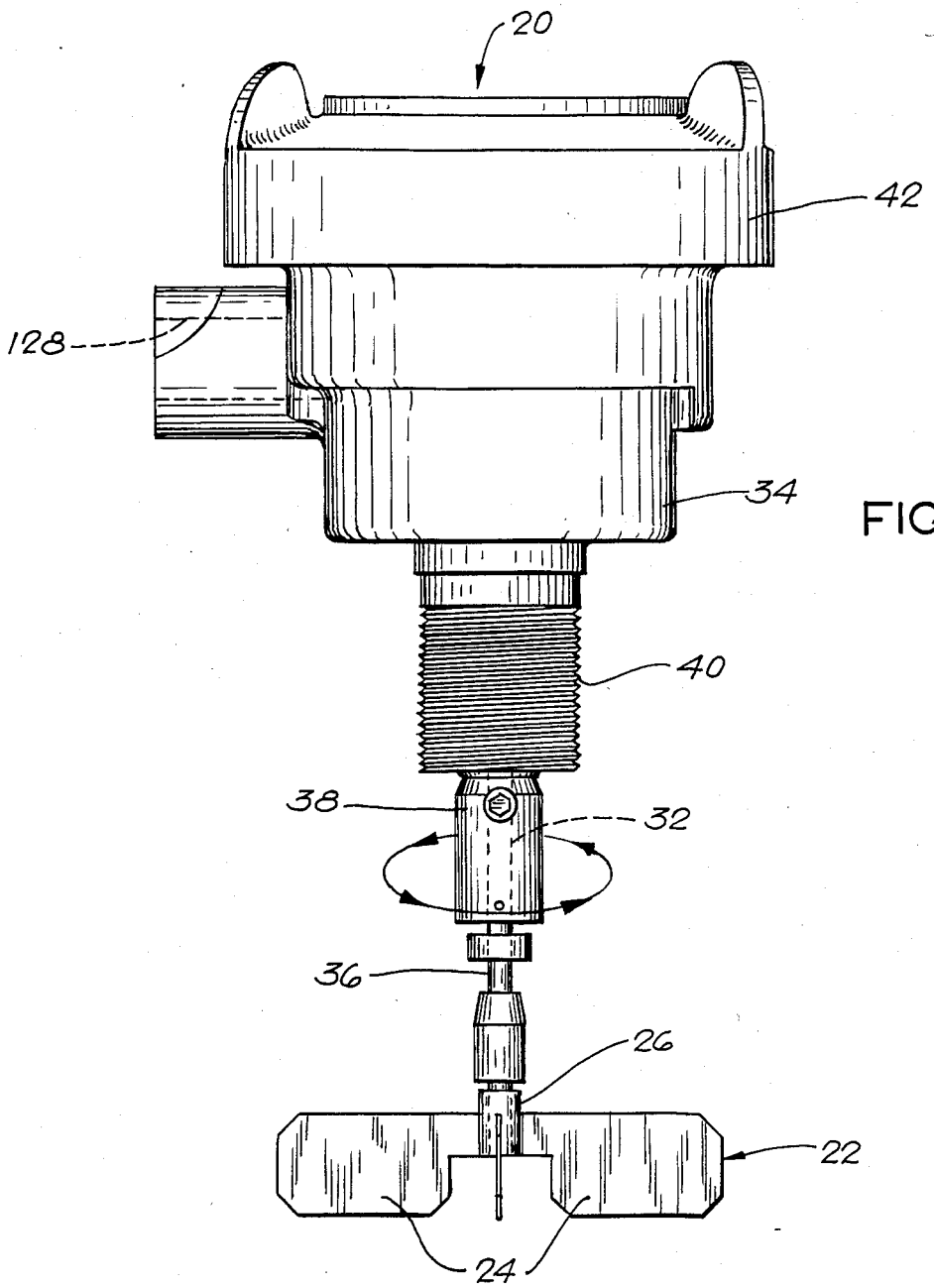
FIG. 1 is an elevational view of a level control device to be described as an illustrative embodiment of the present invention.
Figure 2:
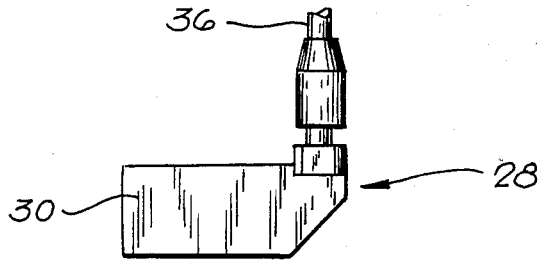
FIG 2 is a fragmentary elevation, showing an alternate paddle or drag member for the level control device of FIG. 1.

As just indicated, the drawings illustrate a level control device 20, sometimes referred to as a bin level indicator, which is of the type having a rotary paddle wheel or drag member 22, adapted to come into contact with rising granular or particulate material in a bin, silo, tank or other container. Ther rotary drag member 22 may assume a variety of forms. As shown in FIG. 1, the paddle wheel 22 has a plurality of angularly spaced paddles 24, radiating from a hub 26. FIG. 2 shows an alternate paddle wheel or drag member 28 having only a single paddle 30.

The level control device 20 has rotatable shaft means, including a shaft 32 which projects out of a housing 34 and is rotatably mounted in such housing. The paddle wheel 22 has a shaft 36 which is connected to the shaft 32 by a coupling 38. The housing 34 has a threaded end portion 40 which is adapted to be screwed into a pipe flange or the like, which may be employed to mount the level control device 20 on one wall of a bin or the like.

The housing 34 has a removable cover 42, which, for example, may be unscrewed. In FIGS. 4 and 5, the level control device 20 is shown with the cover 42 removed.

Within the housing 34, the main output shaft 32 is coupled to a carrier 44, shown as being in the form of a circular plate or disc. As shown in FIG. 12, an overload slip clutch 46 is preferably provided between the carrier 44 and the shaft 32. The slip clutch 46 is shown as being of the ball detent type, comprising a plurality of spring pressed balls 48 which are rotatably carried by the carrier plate 44 and which are normally detained in openings 50 formed in a flange 52, secured to the upper end of the shaft 32. The slip clutch 46 does not normally slip during operation of the level control device 20 but is capable of slipping under unusually high torque conditions, to prevent any possible damage to the level control device.

The carrier 44 is provided with at least one torque-transmitting device 60, and preferably a plurality of such devices, angularly spaced around the carrier 44, relative to the axis of the main shaft 32. As shown, the carrier 44 supports a plurality of such torque-transmitting devices 60 which take the form of levers, swingably mounted on the carrier 44. In the illustrated construction, the carrier is provided with three such torque-transmitting devices 60, equally spaced around the carrier. Each torque-transmitting device 60 has first means for receiving driving torque, which is transmitted to the carrier 44, and second means for performing a control function, when the driving torque increases sufficiently.

As shown in FIGS. 8–12, each torque-transmitting device or lever 60 is preferably made of wire or rod material, having a pivot shaft portion 62 which is rotatably mounted on the carrier 44, as by means of bearing elements 64, which may be formed out of the sheet metal of the carrier 44, which preferably takes the form of a plate or a disc. The pivot shaft portion 62 preferably extends in a generally radial direction, relative to the shaft 32.

The torque-receiving means of each lever 60 may take the form of a first lever arm 66, bent in one lateral direction from the radially inward end of the pivot shaft portion 62. The second or control function portion of each lever 60 may take the form of a second lever arm 68, bent in a different direction from the radially outward end of the pivot shaft portion 62. All three of the levers 60 are similarly formed with the first and second lever arms 66 and 68.

As shown in FIGS. 9–12, the second lever arms 68 are adapted to operate a control member, preferably in the form of a plate 70, which is rotatable with the carrier 44 but is movable relative thereto by the swinging movement of the lever arms 68. The control plate 70 is movable in first and second directions relative to the carrier 44. In this case, the control plate 70 is movable axially, toward and away from the carrier 44.

As shown in FIGS. 9 and 10, the level control device 20 is preferably provided with spring means 72 for biasing the control member or plate 70 in its first direction of movement, in this case, toward the carrier 44. The spring means 72 may also cause the control plate 70 to rotate with the carrier 44.

As shown, the spring means 72 may comprise a plurality of compression coil springs 74, mounted around guide pins 76 which are slidably received in aligned openings 78 in the carrier plate 44 and the control plate 70. Each of the pins 76 has upper and lower heads 80 and 82 at its opposite ends. Each spring 74 is compressed between one of the plates and one of the heads. In this case, each coil spring 74 is compressed between the carrier plate 44 and the lower head 82. Thus, the springs 74 bias the control plate 70 downwardly toward the carrier plate 44, as shown in FIG. 9.

The second lever arm 68 of each lever 60 is disposed between the carrier 44 and the control plate 70. The initial position of the control plate 70 is shown in FIG. 9, with the second lever arms 68 confined between the plates 44 and 70. If the levers 60 are swung clockwise, as shown in FIG. 10, the levers move the control plate 70 away from the carrier 44, against the biasing action of the spring means 72.

As shown in FIGS. 9–12, the first lever arms 66 of the torque-transmitting levers 60 extend generally upwardly, in directions which are angularly related to the carrier 44. The levers 66 are adapted to receive driving torque from drive elements 90 rotatable with a motor output shaft 92 of an electric drive motor 94. Typically, the electric motor 94 is of the gear-reduction type so that the motor output shaft 92 is driven at a slow speed. The motor 94 may be fixedly mounted on a frame member 96 in the housing 34. The drive elements 90 may assume a variety of forms and generally project outwardly, relative to the motor shaft 92, with spaces between the drive elements to receive the lever arms 66. The illustrated drive elements 90 are in the form of pins projecting radially from a hub 98 on the shaft 92. As shown, the drive pins 90 are spaced at equal angular intervals. Each drive pin 90 is adapted to engage one of the torque-transmitting levers 66, as clearly shown in FIGS. 9–11.

The movement of the control plate 70 is employed to operate control switch means, comprising a control switch 100, preferably having a movable operating member 102 with a roller 104 thereon, engageable with the control plate 70. As shown in FIGS. 9 and 10, the control member 102 is swingable upwardly to operate the switch 100.

The switch 100 may be employed to perform a variety of control functions when it is operated. For example, the switch 100 may be employed to actuate an alarm, to stop the flow of the flowable material into the bin or other container, or to initiate the discharge of the flowable material from the bin. The switch 100 may also be employed to de-energize the electric drive motor 94. However, the de-energization of the motor 94 is not strictly necessary, because the slip clutch 46 will protect the motor against overheating.

To provide a sensitivity adjustment, the control switch 100 may be adjustably movable, as shown in FIGS. 6 and 7, to adjust the extent to which the control plate 70 must be moved to operate the switch 100. As shown in FIG. 6, the roller 104 of the switch 100 is moved away from the control plate 70 to afford low sensitivity. As shown in FIG. 7, the roller 104 is moved toward the initial position of the control plate 70, to provide high sensitivity.

To afford the sensitivity adjustment, the control switch 100 is mounted on an adjustable support member in the form of a plate 110 which is swingable about a pivot 112 on a frame member 114. Means may be provided to maintain the movable support member 110 in its adjusted position. As shown, the swingable support member 110 is formed with a series of detent notches 116, adapted to receive a wire spring 118, mounted on a frame member 120.

As shown in FIG. 4, the level control device 20 may have a terminal board 124, to which the drive motor 94 and the control switch 100 may be connected. The terminal board 124 facilitates the connection of external electrical leads 126 to the control device 20. The electrical leads 126 may be brought in through an opening 128 in the housing 34. The opening 128 is adapted to receive an electrical conduit, through which the leads 126 extend.

In a typical application of the level control device 20, the threaded end portion 40 of the housing 34 is screwed into a pipe flange or the like, mounted over an opening in one wall of a bin, silo, tank or other container. The main shaft 32 and the paddle shaft 36 extend into the bin, so that the paddle or drag member 22 or 28 is rotatable within the bin.

When the granular material 54 is at a low level, out of contact with the paddle, as shown in FIG. 9, the electric drive motor 94 continuously rotates the paddle 28 at a relatively low speed. More specifically, the drive motor 94 rotates the motor shaft 92, the hub 98, and the drive pins or elements 90. The pins 90 engage the upwardly extending lever arms 66 of the levers 60 and transmit torque to the arms 66, which in turn transmit torque to the carrier plate 44. The slip clutch 46 transmits the torque to the main shaft 32, to which the paddle 28 is connected.

When the granular material 54 rises sufficiently in the bin to contact the paddle 28, as shown in FIG. 10, the granular material 54 imposes drag on the paddle or drag member 28. Such drag impedes the rotation of the paddle 28, the main shaft 32, the carrier 44, and the levers 60. Accordingly, increased torque is transmitted to the lever arms 66 by the drive pins or elements 90. The increased torque causes the lever arms 66 to swing clockwise, as shown in FIG. 10, so that the second lever arms 68 move the control plate 70 upwardly, away from the carrier plate 44. It will be seen that the second lever arms 68 are curved in shape so that they act in the manner of cams. The upwardly moving control plate 70 engages the switch roller 104 and causes the switch-operating member or lever 102 to swing upwardly so as to operate the control switch 100. The operation of the switch 100 may be employed to actuate an alarm, to stop the flow of the granular material into the bin, to initiate the outward flow of the granular material from the bin, and to perform other control functions. The operation of the switch 100 also usually de-energizes the electric drive motor 94. The de-energization of the motor 94 prevents any possible overheating of the motor due to the increased torque. However, it is not strictly necessary to de-energize the motor 94, because the slip clutch 46 will slip if the paddle 28 is stopped, so that the motor 94 can continue to operate without overheating. The slip clutch 46 primarily protects the level control device 20 against any possible damage due to unusually high torque conditions, which may occur, for example, if high torque is applied to the paddle 28.

The sensitivity of the level control device 20 can be adjusted by moving the swingable plate 110 so as to adjust the position of the switch 100, as shown in FIGS. 6 and 7. As shown in FIG. 6, the adjusting plate 110 is at or near its position of minimum sensitivity, in which the switch roller 104 is spaced away from the initial position of the control plate 70, so that the control plate 70 must be moved a considerable distance by the torque-transmitting levers 60, before the switch 100 is operated. As shown in FIG. 7, the adjusting plate 110 is at or near its position of maximum sensitivity, in which the switch roller 104 is close to or in engagement with the control plate 70, so that only a small movement of the control plate 70 is required to operate the switch 100. The wire spring 118 is received in one of the notches 116 in the adjusting plate 110, to maintain the adjustment of the plate.

The sensitivity adjustment is desirable to obtain the best operation of the level control device 20 for use with a wide variety of granular or particulate materials. For use with materials of low density, a high sensitivity adjustment may be more suitable. For use with heavier granular materials, it may be desirable to reduce the sensitivity.

The bin level control 20 provides a quick and reliable response, because the operative components, including the torque-transmitting levers 60, the control plate 70 and the movable switch operating member 102 have low masses and are freely movable. Moreover, the level control device 20 is uncomplicated and inexpensive to manufacture.

It will be seen from FIG. 5 that the control plate 70 is in the form of a disc which may have a central opening 129, through which the torque-transmitting lever arms 66 extend upwardly, for engagement by the drive elements 90.

FIGS. 13 and 14 illustrate a modified construction, in which the drive elements or pins 90 are replaced by driving means 130, comprising a disc or wheel 132, mounted on the motor shaft 92 and rotatable therewith. The disc 132 is provided with a plurality of angularly spaced openings or holes 134, adapted to receive the lever arms 66. The disc 132 has solid elements 136 between the adjacent openings 134, and such solid elements 136 serve as drive elements for the lever arms 66. The solid elements 136 are in the nature of spokes or radial arms. The apertured disc 132 has the advantages of being easy to manufacture and low in cost. The disc 132 may be made at low cost from a resinous plastic material.

In some cases, the cost of the switch 100 can be reduced by eliminating the roller 104 and its mounting means on the operating arm or leaf 102 of the switch, so that the movable plate 70 directly engages the spring leaf 102.

The level control device 20 has an advantageous modular construction, in which the motor 94 is mounted on the frameplate 96, while the switch 100 is mounted on the frameplate 120. Both frameplates 96 and 120 are secured to the housing 34 by screws 138 and 140, so that the mounting plates 96 and 120 can easily be removed and installed in the housing 34.

When the motor 94 and its mounting plate 96 are installed, the radial drive pins 90 can easily be positioned in the proper relationship with the lever arms 66.

In the case of the modified embodiment of FIGS. 13 and 14, employing the apertured disc 132, it is easy to install the motor 94 so that the lever arms 66 are received in the openings or holes 134 in the disc 132. To facilitate such installation, the illustrated disc 132 is formed with six of the openings 134, to receive the three lever arms 66.

The provision of separate motor and switch modules makes it possible to replace either the motor module or the switch module separately. Moreover, a variety of different switch and motor modules may be provided, for installation in any desired combination. It is particularly advantageous to be able to provide a variety of switch modules for use with the same basic motor module. The provision of separate motor and switch modules reduces the number and cost of the different modules which need to be kept in inventory. The assembly of the motor and switch modules is quick and easy. Moreover, the adjustment of the switch modules is very easily and quickly accomplished.

What is claimed is:

1. A level control device, comprising
a housing,
shaft means rotatable in said housing and having a projecting portion extending from said housing,
paddle means on said projecting portion for engagement by rising material whose level is to be controlled,
the rotation of said paddle means being impeded by the drag caused by the rising material,
a carrier in said housing and mounted on said shaft means for rotation therewith,
a plurality of levers swingably mounted on said carrier,
an electrical drive motor in said housing and having a motor output shaft disposed generally in axial alignment with said shaft means,
drive means including a plurality of drive elements mounted on said motor output shaft and rotatable therewith,
said levers having respective first arms engageable with said drive elements for transmitting driving torque to said levers and then to said carrier,
a control plate adjacent said carrier and movable toward and away from said carrier,
spring means biasing said control plate towards said carrier and causing said control plate to rotate with said carrier,
said levers having respective second arms disposed between said carrier and said control plate for moving said control plate away from said carrier when the driving torque transmitted by said first arms increases due to increasing drag on said paddle means caused by the rising material,
and control switch means engageable by said control plate and operable in response to movement of said control plate away from said carrier.

2. A level control device according to claim 1,
in which each of said levers has a pivot shaft portion pivotally mounted on said carrier,
said first arm of each lever extending laterally in one direction from said pivot shaft portion for engagement with one of said drive elements,
said second arm of each lever extending laterally in a different direction from said pivot shaft portion and disposed between said carrier and said control plate.

3. A level control device according to claim 1,
in which each of said levers is made of rod material and comprises a pivot shaft portion pivotally mounted on said carrier and extending generally in a radial direction relative to said shaft means,
said first arm of each lever being bent in one direction from one end of said pivot shaft portion for engagement with one of said drive elements,
said second arm being bent in a different direction from the opposite end of said pivot shaft portion and being disposed between said carrier and said control plate.

4. A level control device according to claim 3,
said control plate having a central opening through which said first arms of said levers extend for engagement with said drive elements.

5. A level control device according to claim 1,
in which each of said levers is made of rod material and comprises a pivot shaft portion pivotally mounted on said carrier and extending in a generally radial direction relative to said shaft means,
said first arm of each lever being bent in one direction from the radially inward end of said pivot shaft portion for engagement with one of said drive elements,
said second arm of each lever being bent in the different direction from the radially outward end of said pivot shaft element for reception between said carrier and said control plate,
said carrier having bearing means for rotatably supporting said pivot shaft portions of said levers.

6. A level control device according to claim 5,
said control plate having a central opening through which said first arms of said levers extend for engagement with said drive elements,
said drive elements extending outwardly from said motor output shaft with spaces between said drive elements for receiving said first arms of said levers,
said switch means comprising a movable operating member for engaging said control plate.

7. A level control device according to claim 1,
said drive elements comprising pins projecting generally in a radial direction from said motor output shaft for engagement with said first arms of said levers.

8. A level control device according to claim 1,
said spring means comprising a plurality of guide pins,
said carrier and said control plate having openings therein for slidably receiving said guide pins,
said guide pins having opposite ends with heads thereon,
said pins having compression coil springs thereon for biasing said pins in the direction to bias said control plate towards said carrier.

9. A level control device according to claim 1,
such spring means comprising a plurality of guide pins,
said carrier being in the form of a carrier plate,
said carrier plate and said control plate having aligned openings therein for slidably receiving said guide pins,
said guide pins having opposite ends with heads thereon,
said guide pins having compression coil springs thereon,
each of said coil springs being compressed between one of said plates and one of said heads on the corresponding guide pin for biasing said control plate toward said carrier plate.

10. A level control device according to claim 1,
including an overload slip clutch normally forming a driving connection between said carrier and said shaft means while providing for slippage therebetween under conditions of torque overload.

11. A level control device according to claim 1,
including adjustably movable mounting means for supporting said switch means for adjusting movement relative to said control plate to adjust the degree of movement of said control plate required to operate such switch means.

12. A level control device according to claim 1, said switch means having a movable control member with a roller thereon for engaging said control plate to operate said switch means in response to movement of said control plate away from said carrier, said switch means having an adjustably movable mounting member supporting said switch means to adjust the position of said roller relative to said control plate for providing a sensitivity adjustment determining the amount of movement of said control plate required to operate said switch means.

13. A level control device, comprising a housing, shaft means rotatable in said housing and having a projecting portion extending from said housing, a material contacting drag member on said projecting portion for contacting rising material whose level is to be controlled, the rotation of the drag member being impeded by the drag on said member caused by the rising material, a carrier in said housing and mounted on such shaft means for rotation therewith, at least one torque-transmitting device movably mounted on said carrier, a drive motor in said housing and having a motor output shaft with at least one drive element thereon, said torque-transmitting device having first means engageable with said drive element for transmitting driving torque to said first means and then to said carrier, a control member rotatable with said carrier and movable relative thereto in first and second directions, spring means biasing said control member in said first direction, said torque-transmitting device having second means for moving said control member in said second direction when the driving torque transmitted by said first means increases due to increasing drag on said drag member caused by the rising material, and control switch means engageable by said control member and operable in response to movement of said control member in said second direction by said torque-transmitting device.

14. A level control device according to claim 13, in which said torque-transmitting device comprises a lever swingably mounted on said carrier, said first and second means comprising first and second arms of said lever for engagement with said drive element and said control member.

15. A level control device according to claim 13, in which said torque-transmitting device is one of a plurality of such torque-transmitting devices movably mounted on said carrier and spaced at angular intervals around said shaft means, said control member being movable generally in first and second axial directions toward and away from said carrier relative to the axis of said shaft means, said drive element comprising one of a plurality of such drive elements for engagement with said first means of said torque-transmitting devices.

16. A level control device according to claim 15, each of said torque-transmitting devices comprising a lever swingably mounted on said carrier, said first and second means of each torque-transmitting device comprising first and second arms of the corresponding lever for engagement with the corresponding drive element and with said control member for moving said control member against the biasing action of said spring means.

17. A level control device according to claim 16, said spring means comprising springs mounted on guide means extending between said carrier and said control member for biasing said control member toward said carrier, said second arms of said levers extending between said carrier and said control member for moving said control member away from said carrier in response to the transmission of increasing torque between said drive elements and said first arms of said levers, said switch means comprising a movable operating member engageable with said control member for operating such switch means in response to movement of said control member away from said carrier.

18. A level control device according to claim 1, said drive means including a disc mounted on said motor output shaft, said disc having a plurality of angularly spaced openings therein for receiving said first arms of said levers, said disc having solid portions between said openings and forming said drive elements.

19. A level control device according to claim 1, including a motor mounting member supporting said motor and removably mounted in said housing, and a switch mounting member supporting said control switch means and removably mounted in said housing.

20. A level control device according to claim 14, said drive element comprising a drive disc mounted on said motor output shaft, said disc having at least one opening therein for receiving said first arm of said lever.

* * * * *